US007040106B1

(12) United States Patent
Hamel

(10) Patent No.: US 7,040,106 B1
(45) Date of Patent: May 9, 2006

(54) AIR CONDITIONING SYSTEM WITH SECONDARY COMPRESSOR DRIVE

(76) Inventor: Jerry Hamel, 2689 Junction Hwy., Kerrville, TX (US) 78028

( * ) Notice: Subject to any disclaimer, the term of this patent is extended or adjusted under 35 U.S.C. 154(b) by 0 days.

(21) Appl. No.: 10/901,587

(22) Filed: Jul. 29, 2004

(51) Int. Cl.
*F25B 49/00* (2006.01)

(52) U.S. Cl. ..... 62/228.1; 62/236

(58) Field of Classification Search ..... 62/132, 62/236, 228.1, 305, 228.3, 87, 323.3, 401, 62/323.4, 403, 228.4, 402
See application file for complete search history.

(56) References Cited

U.S. PATENT DOCUMENTS 3,826,096 A * 7/1974 Hrusch ..... 60/709
3,832,853 A * 9/1974 Butler, Jr. ..... 60/641.12
4,028,008 A * 6/1977 Shelton ..... 417/52
4,498,306 A * 2/1985 Tyree, Jr. ..... 62/119
4,617,801 A * 10/1986 Clark, Jr. ..... 62/116
5,239,830 A * 8/1993 Banthin et al. ..... 60/718
5,551,247 A * 9/1996 Manz et al. ..... 62/149
5,713,210 A * 2/1998 Jirnov et al. ..... 62/87
6,351,957 B1 * 3/2002 Hara ..... 62/133
6,378,163 B1 * 4/2002 Moll et al. ..... 15/322
6,543,243 B1 * 4/2003 Mohrmann et al. ..... 62/230
6,758,049 B1 * 7/2004 Adachi et al. ..... 62/115
6,761,037 B1 * 7/2004 Tsuboi et al. ..... 62/244
6,786,055 B1 * 9/2004 Inoue et al. ..... 62/133
6,796,138 B1 * 9/2004 Imai et al. ..... 62/236
6,802,187 B1 * 10/2004 Kawahara ..... 62/228.1
6,823,690 B1 * 11/2004 Runk et al. ..... 62/323.3

FOREIGN PATENT DOCUMENTS

DE 2848532 A1 * 5/1980
JP 4-364372 A * 12/1992
JP 1331115 A2 * 7/2003
JP 2003-301787 A * 10/2003
JP 1400689 A1 * 3/2004

* cited by examiner

*Primary Examiner*—Mohammad M. Ali
(74) *Attorney, Agent, or Firm*—Wayne J. Colton, Inc.

(57) ABSTRACT

A secondary drive system for an air conditioner compressor includes a conventional air conditioning circuit having integrated therewith a secondary compressor drive. The secondary compressor drive includes an air motor for selectively operating the otherwise conventional compressor of the air conditioning circuit and a compressed fluid source for driving the air motor. The compressed fluid source includes a pressure vessel and a collection reservoir. Heat generated in the operation of the air conditioning circuit is utilized to convert a liquid phase of the operating fluid into a highly compressed gas within the pressure vessel whereafter the resulting compressed gas is utilized to drive the air motor. The air motor operates the compressor of the air conditioning circuit. The operating fluid is captured within the collection reservoir as a gaseous or vaporous operating fluid for reuse in the system of the present invention.

14 Claims, 3 Drawing Sheets

AIR CONDITIONING SYSTEM WITH SECONDARY COMPRESSOR DRIVE

FIELD OF THE INVENTION

The present invention relates to air conditioning systems. More particularly, the invention relates to an air conditioning system with provision of a secondary compressor drive system that operates on recycled excess heat energy from an otherwise conventional air conditioner circuit.

BACKGROUND OF THE INVENTION

Over the last fifty years, air conditioning, as an answer to excessively warm weather, has gone from a luxury for the privileged few to a convenience enjoyed by many. As a result, the cost of installing an air conditioning system in a home is now low enough to be easily absorbed within the price of nearly any home. Unfortunately, however, notwithstanding the relatively lower initial costs associated with purchasing and installing an air conditioning system, the costs of operating such an air conditioning system can still be prohibitively high—especially in the warmest climates where the benefits are most needed.

It is therefore an overriding object of the present invention, especially in light of ever increasing energy costs, to improve generally upon the prior art by setting forth a method and apparatus for a more energy efficient air conditioning system. Additionally, it is an object of the present invention to provide such an air conditioning system that utilizes a secondary compressor drive to capitalize upon otherwise wasted energy in a conventional air conditioning system to increase energy efficiency. Still further, it is an object of the present invention to provide such as system in a manner that does not prohibitively increase the initial costs of purchase and installation.

SUMMARY OF THE INVENTION

In accordance with the foregoing objects, the present invention—a secondary drive system for an air conditioner compressor—generally comprises a substantially conventional air conditioning circuit having integrated therewith a secondary compressor drive. In the preferred embodiment of the present invention, the secondary compressor drive includes an air motor for selectively operating the otherwise conventional compressor of the air conditioning circuit and a compressed fluid source for driving the air motor. The compressed fluid source includes a pressure vessel and a collection reservoir. Heat generated in the operation of the air conditioning circuit is utilized to convert a liquid phase of the operating fluid into a highly compressed gas within the pressure vessel whereafter the resulting compressed gas is utilized to drive the air motor. The air motor in turn operates the compressor of the otherwise conventional air conditioning circuit. After passage through the air motor, the operating fluid is captured within the collection reservoir as a gaseous or vaporous operating fluid for reuse in the system of the present invention.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 1:
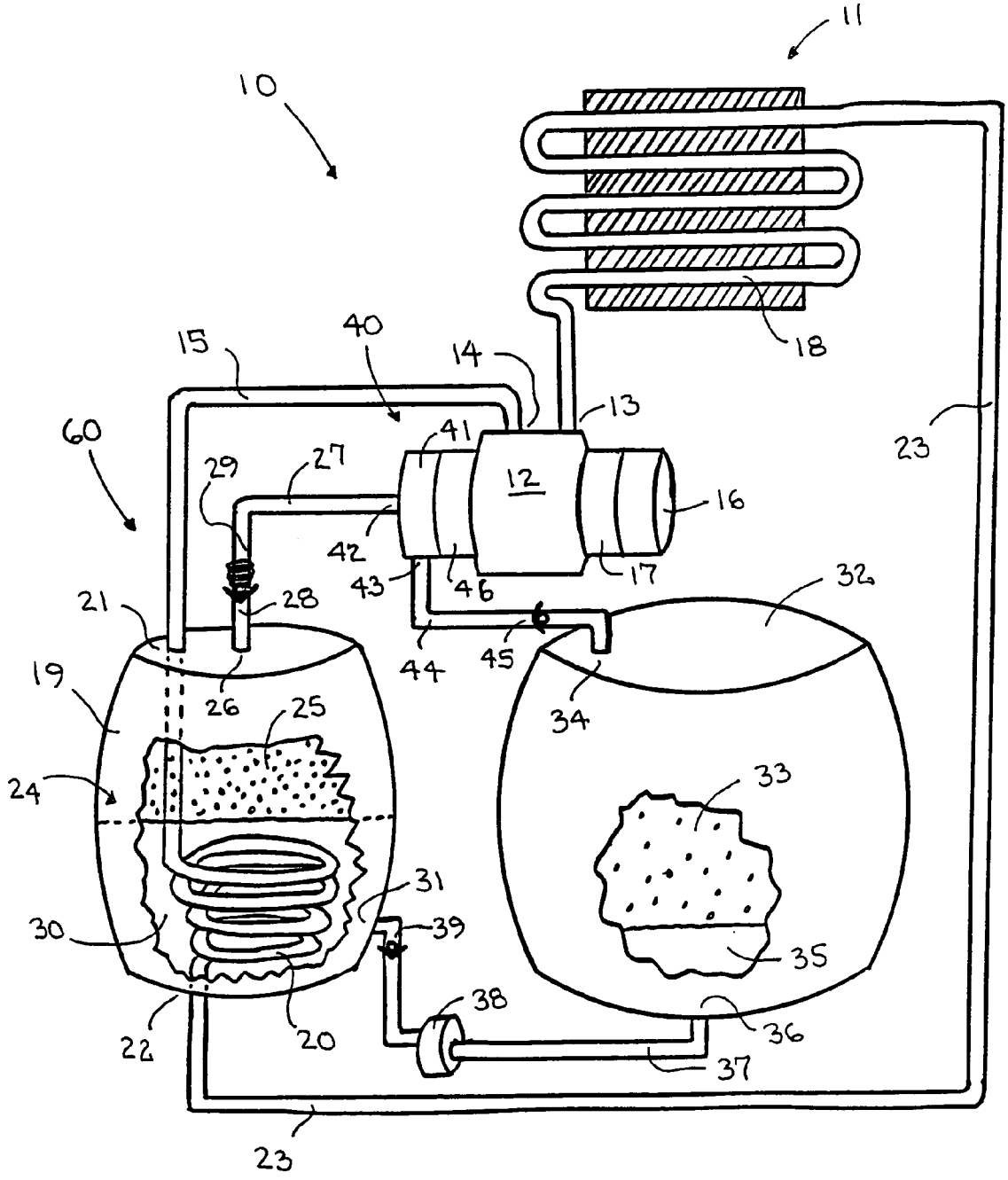
FIG. 1 shows, in a schematic block diagram, the preferred embodiment of the air conditioner drive system of the present invention.

As particularly shown in FIG. 1, the air conditioner drive system 10 of the present invention generally comprises a substantially conventional air conditioning circuit 11 having integrated therewith a secondary compressor drive 40. In the preferred embodiment of the present invention, the secondary compressor drive 40 includes an air motor 41 for selectively operating the otherwise conventional compressor 12 of the air conditioning circuit 11 and a compressed fluid source 60 for driving the air motor 41. As will be better understood further herein, the compressed fluid source 60 includes a pressure vessel 19 and a collection reservoir 32. As also will be better understood further herein, heat generated in the operation of the air conditioning circuit 11 is utilized to convert a liquid phase 30 of the operating fluid 24 into a highly compressed gas 25 within the pressure vessel 19, whereafter the resulting compressed gas 25 is utilized to drive the air motor 41 which in turn operates the compressor 12 of the otherwise conventional air conditioning circuit 11. After passage through the air motor 41, the operating fluid 24 is captured within the collection reservoir 32 as a gaseous or vaporous operating fluid 33 for reuse in the system of the present invention.

Referring still to FIG. 1 in particular, the pressure vessel 19 of the preferred embodiment of the present invention is shown to contain the condenser coil 20 for the otherwise conventional air conditioning circuit 11. Preferably, the condenser coil 20 is located in the lower portion of the pressure vessel 19 such that the condenser coil 20 is generally submerged within the liquid phase 30 of the operating fluid 24, which may comprise any highly compressible gas such as commonly employed in air conditioning systems. Because, as will be apparent to those of ordinary skill in the art, the conventional operation of the compressor 12 of the air conditioning circuit 11 will heat the liquid phase 30 of the operating fluid 24 as the operating fluid of the air conditioning circuit 11 passes through the condenser coil 20, it is to be expected that the operating fluid 24 will be heated from its liquid phase 30 into a highly compressed gas 25 within the pressure vessel 19. In order to obtain this desired effect, however, it should also be recognized that the condenser coil 20 must be suspended within the pressure vessel 19 between a hermetically sealed conduit 21 into the interior of the vessel 19 and a hermetically sealed conduit 22 out of the vessel 19.

As also particularly shown in FIG. 1, the collection reservoir 32 generally comprises a simple tank, which is preferably significantly larger in size than the pressure vessel 19 in order to collect the operating fluid 24 after passage through the air motor 41 without impeding operating of the air motor 41. As will be appreciated by those of ordinary skill in the art, especially in light of this exemplary description, the collection reservoir 32 need not have the structural integrity of the pressure vessel 19 as the collection reservoir 32 will serve only to recapture the gaseous or vaporous operating fluid 33 from the air motor 41, allow the operating fluid 33 to cool into a liquid operating fluid 35 and store the liquid operating fluid 35 until such time as it may be transferred back into the pressure vessel 19. As shown in the figure, the collection reservoir 32 preferably comprises in inlet 34 to the top of the reservoir 32 for receiving the operating fluid 24 from the air motor 41 and an outlet 36 from the bottom of the reservoir 32 for return of the operating fluid 24 to the pressure vessel 19. A transfer channel 37, which may simply comprise a pipe or the like, interconnects the outlet 36 from the collection reservoir 32 to an inlet 31 provided in the lower portion of the pressure vessel 19. As will be better understood further herein, a transfer pump 38, which may comprise a simple centrifugal pump or the like, is preferably provided in the transfer channel 37 for pumping the liquid operating fluid 35 from the collection reservoir 32 to replenish the liquid phase 30 of the operating fluid 24 within the pressure vessel 19. While those of ordinary skill in the art will recognize that other means for transfer may be implemented, such as, for example, gravity feed systems or the like, it is in any case critical that a check valve 39 or the like be provided within the transfer channel 37 to prevent backflow from the pressure vessel 19 to the collection reservoir 32.

Figure 2:
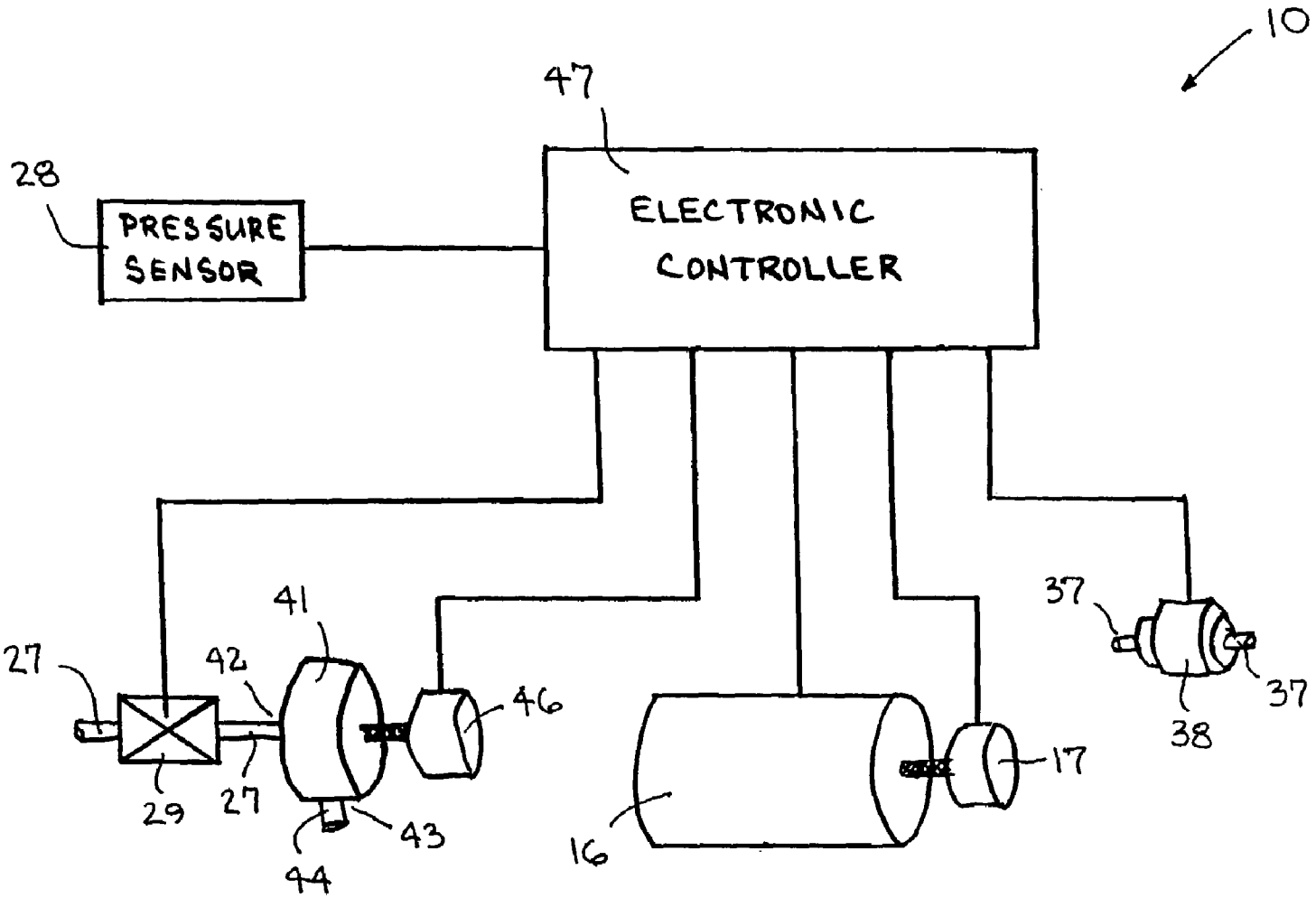
FIG. 2 shows, in a schematic diagram, details of at lease one implementation of a control system for the air conditioner drive system of FIG. 1.

As in shown in FIGS. 1 and 2, the compressor 12 of the air conditioner drive system 10 is operably connected to the air motor 41 through an interposed clutch 46. As will be appreciated by those of ordinary skill in art, any of a variety of clutch mechanisms may be implemented to this end. For example, the clutch 46 may be implemented utilizing the well known clutch mechanism typically associated with automobile air conditioning systems. Likewise, the electric compressor motor 16 of the otherwise conventional air conditioning circuit 11 is operably connected to the compressor 12 though a second interposed clutch 17, which may be of the same design as the clutch 46 for the air motor 41. In operation of the air conditioner drive system 10 of the present invention, the clutches 17, 46 are utilized to selectively engage and disengage the electric compressor motor 16 and the air motor 41, respectively, thereby preventing interference with each other during operation of one or the other. As particularly shown in FIG. 2, the clutches 17, 46, as well as the other components of the air conditioner drive system 10 of the present invention, may be controlled with an electronic controller 47, the implementation of which is within the ordinary skill in the art.

Figure 3:
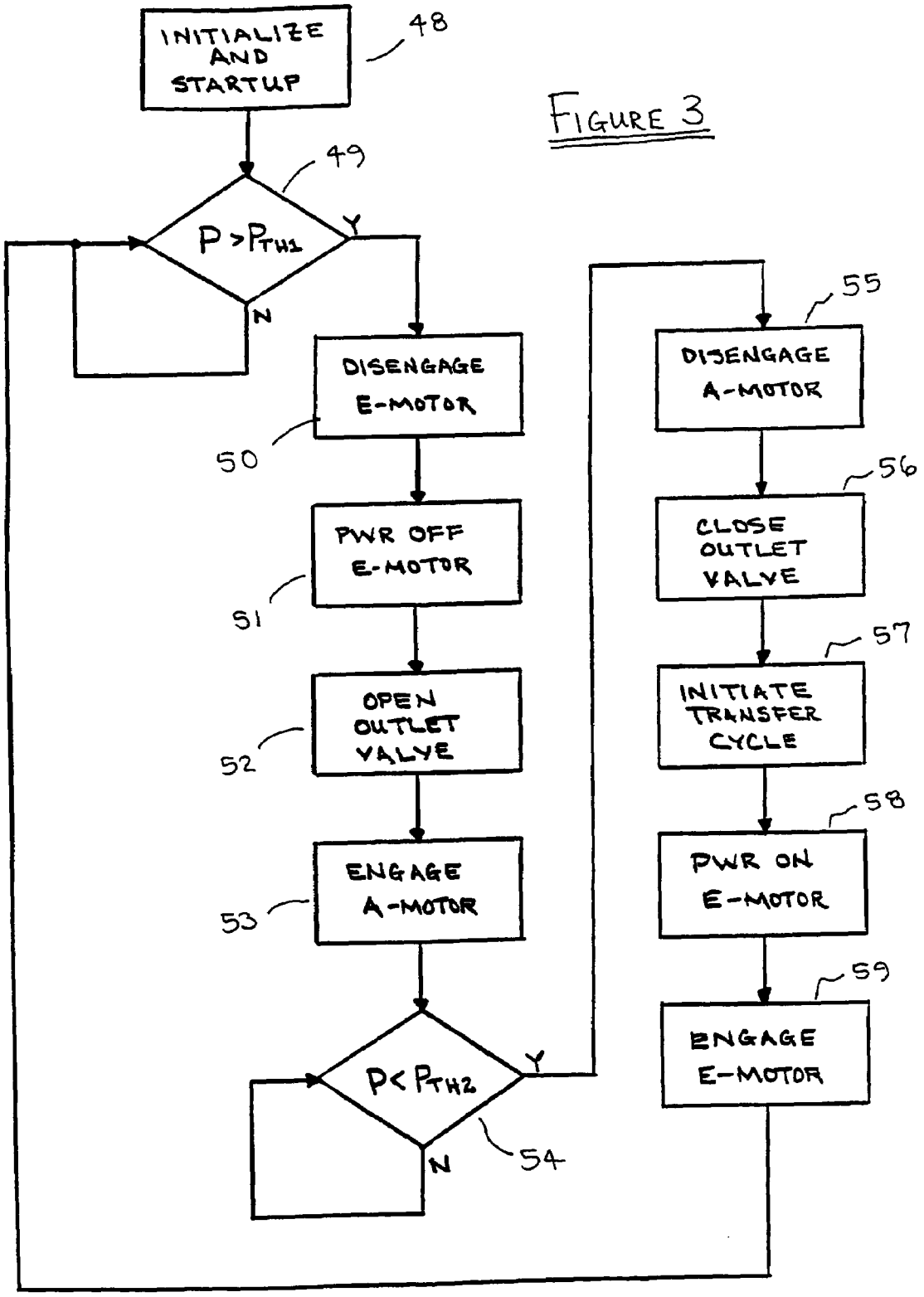
FIG. 3 shows, in a flowchart, details of at least one method of operation of the air conditioner drive system of FIG. 1.

Referring now to FIG. 3 in particular, but with reference to FIGS. 1 and 2 as well, one exemplary method of operation of the air conditioner drive system 10 of the present invention is detailed. As shown in FIG. 3, operation of the system 10 will generally commence (step 48) with an initialization and startup sequence under the control of the electronic controller 47. During such a sequence, the clutches 17, 46 and the electric compressor motor 16 are set such that the air motor 41 is disengaged from the compressor 12 while the electric compressor motor 16 is engaged with the compressor 12. The electric compressor motor 16 then operates the compressor 12 to begin the flow of operating fluid from the outlet 14 of the compressor 12 into the high side of the air conditioning circuit 11.

The highly pressurized, gaseous operating fluid flowing from the outlet 14 of the compressor 12 flows through a conventional channel 15 from the compressor 12, through the hermetically sealed conduit 21 into the interior of the pressure vessel 19 and into the condenser coil 20 contained in the lower portion of the vessel 19. As is conventional, the operating fluid of the air conditioning circuit 11 is converted by the condenser coil 20 into a highly compressed liquid in a process generating substantial heat energy. This heat energy is in turn conducted from the condenser coil 20 into the liquid phase 30 of the operating fluid 24 of the secondary compressor drive 40. As the liquid phase 30 becomes heated, the operating fluid 24 is converted to a highly compressed gas 25 contained within the upper portion of the pressure vessel 19. The pressure of the compressed gas 25 is monitored (step 49) with a pressure sensor 28, preferably contained, for ease of maintenance, within a pressure line 27 from a provided outlet 26 in the top of the pressure vessel 19 to the inlet 42 of the air motor 41. In particular, the electronic controller 47 monitors (step 50) the pressure of the compressed gas 25 to determine when sufficient pressure exists within the pressure vessel 19 to drive the air motor 41 with enough power to operate the compressor 12 of the air conditioning circuit 11.

When the electronic controller 47 determines that the pressure of the compressed gas 25 within the pressure vessel 19 exceeds a predetermined threshold pressure, the electronic controller 47 orchestrates a sequence of events to selectively switch power of the compressor 12 from the electric compressor motor 16 to the air motor 41. In particular, as shown in FIG. 3, the electronic controller 47 operates the clutch 17 of the electric compressor motor 16 to disengage the electric compressor motor 16 from the compressor 12. The electronic controller 47 then powers off (step 51) the electric compressor motor 16 to conserve electrical energy. A flow control valve 29, interposed within the pressure line 27 from outlet 26 of the pressure vessel 19 to the inlet 42 of the air motor 41 is then opened (step 52) by the electronic controller 47, whereafter the electronic controller 47 operates (step 53) the clutch 46 associated with the air motor 41 to engage the air motor 41 with the compressor 12.

With the air motor 41 engaged to operate the compressor 12 of the air conditioning circuit 11 (and the electric compressor motor 16 disengaged), the air conditioning circuit 11 operates as usual so long as there remains within the pressure vessel 19 compressed gas 25 of sufficient pressure. To this end, the electronic controller 47 monitors (step 54) the pressure of the compressed gas 25 within the pressure vessel 19. During this period, the compressed gas phase 25 of the operating fluid 24 passes through the air motor 41 and out of the outlet 43 from the air motor 41 though an exhaust line 44 into the inlet 34 to the top of the collection reservoir 32. With time, the operating fluid 24 will be largely displaced from the pressure vessel 19 to the collection reservoir 32, resulting in the pressure measured by the pressure sensor 28 falling below a second predetermined threshold pressure. When the electronic controller 47 determines that the pressure of the compressed gas 25 within the pressure vessel 19 has fallen below the second predetermined threshold pressure, the electronic controller 47 orchestrates a sequence of events to selectively switch power of the compressor 12 from the air motor 41 back to the electric compressor motor 16 as well as to transfer (step 57) the liquid operating fluid 35 collected within the collection reservoir 32 back to the pressure vessel 19.

In particular, the electronic controller 47 operates (step 55) the clutch 46 associated with the air motor 41 to disengage the air motor 41 from the compressor 12. The electronic controller 47 then closes (step 56) the flow control valve interposed within the pressure line 27 between the pressure vessel 19 and the air motor 41. At this time, the transfer cycle for returning operating fluid 24 to the pressure vessel 19 may be initiated (step 57), utilizing the transfer pump 38 as necessary. The electronic controller 47 then powers on (step 58) the electric compressor motor 16 and operates (steps 59) the clutch 17 associated with electric compressor motor 16 to again engage the electric compressor motor 16 with the compressor 12. The air conditioning circuit 11 then operates conventionally until such time as the controller 47 again determines that the pressure of the compressed gas 25 within the pressure vessel 19 exceeds the first predetermined threshold pressure (step 49 repeated).

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. For example, those of ordinary skill in the art will recognize that the otherwise conventional air conditioning circuit 11 must be provided with a variety of conventional components such as, for example, a channel 23 interconnecting the condenser coil 20 with a provided evaporator 18 as well as control and other components not described herein but within the ready grasp of those of ordinary skill in the art.

Likewise, those of ordinary skill in the art will recognize the desirability or necessity for the inclusion of check valves and the like to ensure correct direction of fluid flow through the system 10 under all operating conditions. For example, Applicant has found it desirable to include a check valve 45 in the exhaust line 44 leading from the outlet 43 of the air motor 41 to the inlet 34 to the top of the collection reservoir 32, thereby preventing backflow from the collection reservoir 32 to the air motor 41. In any case, because the scope of the present invention is much broader than any particular embodiment, the foregoing detailed description should not be construed as a limitation of the scope of the present invention, which is limited only by the claims appended hereto.

What is claimed is:

1. A secondary drive system for operation of an air conditioner compressor, said secondary drive system comprising:

an air motor, said air motor being selectively engageable with the air conditioner compressor; and a source of compressed fluid for operating said air motor, wherein said fluid is compressed by heat energy generated by said compressor.

2. The secondary drive system as recited in claim 1, wherein said source of compressed fluid comprises a pressure vessel having contained therein:

said fluid;

a condenser coil associated with said air conditioner compressor; and wherein said condenser coil is submerged within said fluid.

3. The secondary drive system as recited in claim 2, said secondary drive system further comprising a clutch interposed said air motor and the compressor for selectively engaging said air motor with the compressor.

4. The secondary drive system as recited in claim 3, wherein said clutch is operated by an electronic controller.

5. The secondary drive system as recited in claim 3, wherein said source of compressed fluid further comprises a collection reservoir, said collection reservoir being adapted to captured said fluid during operation of said fluid air motor.

6. The secondary drive system as recited in claim 5, wherein said collection reservoir is substantially larger than said pressure vessel.

7. The secondary drive system as recited in claim 5, wherein said source of compressed fluid further comprises a pressure sensor associated with said pressure vessel for measuring the pressure of said fluid.

8. The secondary drive system as recited in claim 7, wherein said clutch is operated by an electronic controller according to the pressure measured by said pressure sensor.

9. The secondary drive system as recited in claim 7, wherein said source of compressed fluid further comprises a flow control valve for controlling flow of said fluid from said source to said air motor.

10. The secondary drive system as recited in claim 8, wherein said flow control valve is operated by an electronic controller according to the pressure measured by said pressure sensor.

11. The secondary drive system as recited in claim 10, where said clutch is operated by an electronic controller according to the pressure measured by said pressure sensor.

12. The secondary drive system as recited in claim 7, wherein said source of compressed fluid further comprises a conduit between said collection reservoir and said pressure vessel for return of said fluid from said collection reservoir tot said pressure vessel.

13. The secondary drive system as recited in claim 12, wherein said source of compressed fluid further comprises a transfer pump in said conduit.

14. The secondary drive system as recited in claim 13, wherein said transfer pump is operated by an electronic controller according to the pressure measured by said pressure sensor.

* * * * *